US012405079B2

(12) United States Patent
Cheney

(10) Patent No.: US 12,405,079 B2
(45) Date of Patent: Sep. 2, 2025

(54) RIFLE BUTTSTOCK SUPPORT

(71) Applicant: Ryan Cheney, Conway Springs, KS (US)

(72) Inventor: Ryan Cheney, Conway Springs, KS (US)

( * ) Notice: Subject to any disclaimer, the term of this patent is extended or adjusted under 35 U.S.C. 154(b) by 31 days.

(21) Appl. No.: 18/371,524

(22) Filed: Sep. 22, 2023

(65) Prior Publication Data

US 2025/0027738 A1 Jan. 23, 2025

(51) Int. Cl.
*F41A 27/30* (2006.01)

(52) U.S. Cl.
CPC ..... *F41A 27/30* (2013.01)

(58) Field of Classification Search
CPC ..... F41A 23/16
USPC ..... 42/94
See application file for complete search history.

(56) References Cited

U.S. PATENT DOCUMENTS 4,821,443 A * 4/1989 Bianco ..... F41A 25/02 42/94
5,490,302 A * 2/1996 Dion ..... A47K 7/022 4/606
6,860,054 B1 * 3/2005 Mosher ..... F41A 27/24 42/94
10,895,429 B2 * 1/2021 Bell ..... F41A 19/10
2008/0034636 A1 2/2008 Potterfield et al.
2010/0287810 A1 * 11/2010 Kleppe ..... F16M 11/28 29/428
2012/0246991 A1 * 10/2012 Seuk ..... F41C 33/001 42/94
2013/0081317 A1 4/2013 Mangum
2013/0298439 A1 * 11/2013 Mahnke, III ..... F41A 23/16 42/94

OTHER PUBLICATIONS

Levy-High Rise Shooting Bag, redhawkrifles.com. Accessed Sep. 21, 2023 https://redhawkrifles.com/levy-high-rise-shooting-bag/.
New Inflatable Rear Bag for Hunters and Tactical Shooters, grafs.com. Published May 11, 2015.
US Trademark Registration U.S. Appl. No. 98/094,041, Applicant: Ryan Cheney, Filed Jul. 13, 2023, Directed to rear support bags for precision rifle shooting.

* cited by examiner

*Primary Examiner* — Bret Hayes
(74) *Attorney, Agent, or Firm* — Kenneth H. Jack; Davis & Jack, L.L.C

(57) ABSTRACT

A buttstock support including a base plate having first and second ends; a first flexible sheet having first and second ends respectively fixedly attached to the base plate's first and second ends; a body of particulate material overlying the base plate and underlying the first flexible sheet; an air bag overlying the base plate and underlying the body of particulate material; and an air pump for injecting air into the air bag. The buttstock support includes a second flexible sheet overlying the airbag and underlying the body of particulate material. The buttstock support also includes a first pocket upwardly and downwardly bounded by the first and second flexible sheets. The buttstock support includes a second pocket, upwardly and downwardly bounded by the second flexible sheet and the base plate. The first pocket is opened by a particulate material port and the second pocket is opened by an air bag port.

16 Claims, 8 Drawing Sheets

RIFLE BUTTSTOCK SUPPORT

FIELD OF THE INVENTION

This invention relates to rifles and rifle assemblies utilized in long distance rifle marksmanship. More particularly this invention relates to apparatus and assemblies adapted for stable support of rifles during precision long range firing.

BACKGROUND OF THE INVENTION

Rifle rear stock or rifle buttstock supports which conventionally comprise a bag or sack filled with particulate material such as sand are known. Such buttstock supports commonly hold a rifle's buttstock at a raised elevation over the surface of a table, bench, or ground surface which is utilized as a stable rifle support during precision firing of the rifle. Where a rifleperson utilizing such conventional buttstock support wishes to adjust the elevation of the rifle's buttstock, awkward, imprecise and undesirably time consuming manipulations of the bag's particulate material must be performed.

The instant inventive buttstock support solves or ameliorates the problems, defects, and disadvantages of such common or conventional particulate material filled buttstock supports by incorporating within a buttstock support specialized features including a base plate an expansible airbag, and an air pump.

OBJECT AND SUMMARY OF THE INVENTION

A first structural component of the instant inventive buttstock support comprises a base plate having a first end and a second end. In a preferred embodiment the base plate is approximately one half inch thick, and is either substantially square or rectangular. In a preferred embodiment, where the base plate component is rectangularly configured, the base plate has an approximate eight inch lateral width, and an approximate ten inch longitudinal length. While the longitudinal ends or sides of the base plate may suitably constitute such plate's first and second ends, a lateral or left side of the base plate preferably constitutes the base plate's first end and an oppositely lateral or right end of the base plate constitutes such plate's second end. In a preferred embodiment, the base plate is encased within and includes a fabric or vinyl sheath which is closely fitted to the dimensions of the base plate's internal matrix.

In a preferred embodiment such internal matrix may comprise an approximate one half inch thick and rectangularly shaped rubber slab. The rubber composition of such slab component allows a slight flexible bend imposed upon the plate to facilitate an insertion into a closely fitting or tightly fitted external sheath.

A further structural component of the instant inventive buttstock support comprises a first flexible sheet having first and second ends which are respectively fixedly attached, preferably by stitching to the base plate's first and second ends. In a preferred embodiment, the first flexible sheet is composed of durable vinyl or woven fabric, and such sheet preferably has a lateral dimension which allows such sheet to extend and upwardly arch or curve over an upper surface of the base plate.

A further structural component of the instant inventive buttstock support comprises a body of particulate material such as sand, dried rice, or plastic resin pellets. In the preferred embodiment, the body of particulate material overlies the base plate and underlies the first flexible sheet.

A further structural component of the instant inventive buttstock support comprises an expansible airbag overlying the baseplate and underlying the body of particulate material.

A further structural component of the instant inventive buttstock support comprises means for injecting air into the airbag. In a preferred embodiment, such means comprises a squeeze bulb type air pump in combination with an air tube for communicating compressed air into the expansible air bag. The means for injecting air into the air bag may suitably alternatively comprise a compressed air canister and air tube combination. Also suitably, the air injecting means may alternatively comprise an electric motor driven air compressor which supplies air to the air bag via an air tube. Other types of air pumps such as a reciprocating piston air pump may be suitably utilized.

In use of the instant inventive rifle buttstock support a rifleperson may initially allow his or her rifle to rest upon a firing surface such as the ground, a table, or a bench, the forestock of the rifle commonly being supported by a bipod. Thereafter, the rifleperson may place the instant inventive buttstock support immediately beneath the rifle's rear stock. Thereafter, the rifleperson may actuate the invention's air injecting means to cause the expansible airbag to begin to fill with air. Such airbag filling causes an upper surface of the airbag to bias and deflect upwardly against the overlying body of particulate material. Upward pressure exerted by the airbag, in turn causes such material to deflect upwardly, upwardly raising the rifle's rear stock. In a preferred mode of operation, the rifleperson may continue to operate the air injecting means until the rifle's aiming point lowers to the target. Thereafter, slight or intermittent operations of the air injecting means to introduce air into or to extract air from the air bag may advantageously precisely adjust the aiming elevation of the rifle.

Accordingly, objects of the instant invention include the provision of a rifle buttstock support which incorporates structures as described above, and which arranges those structures in relation to each other in the manners described above for the performance of beneficial functions as described above. Other and further objects, benefits, and advantages of the instant invention will become known to those skilled in the art upon review of the detailed description which follows, and upon review of the appended drawings.

DETAILED DESCRIPTION OF THE INVENTION

Figure 1:
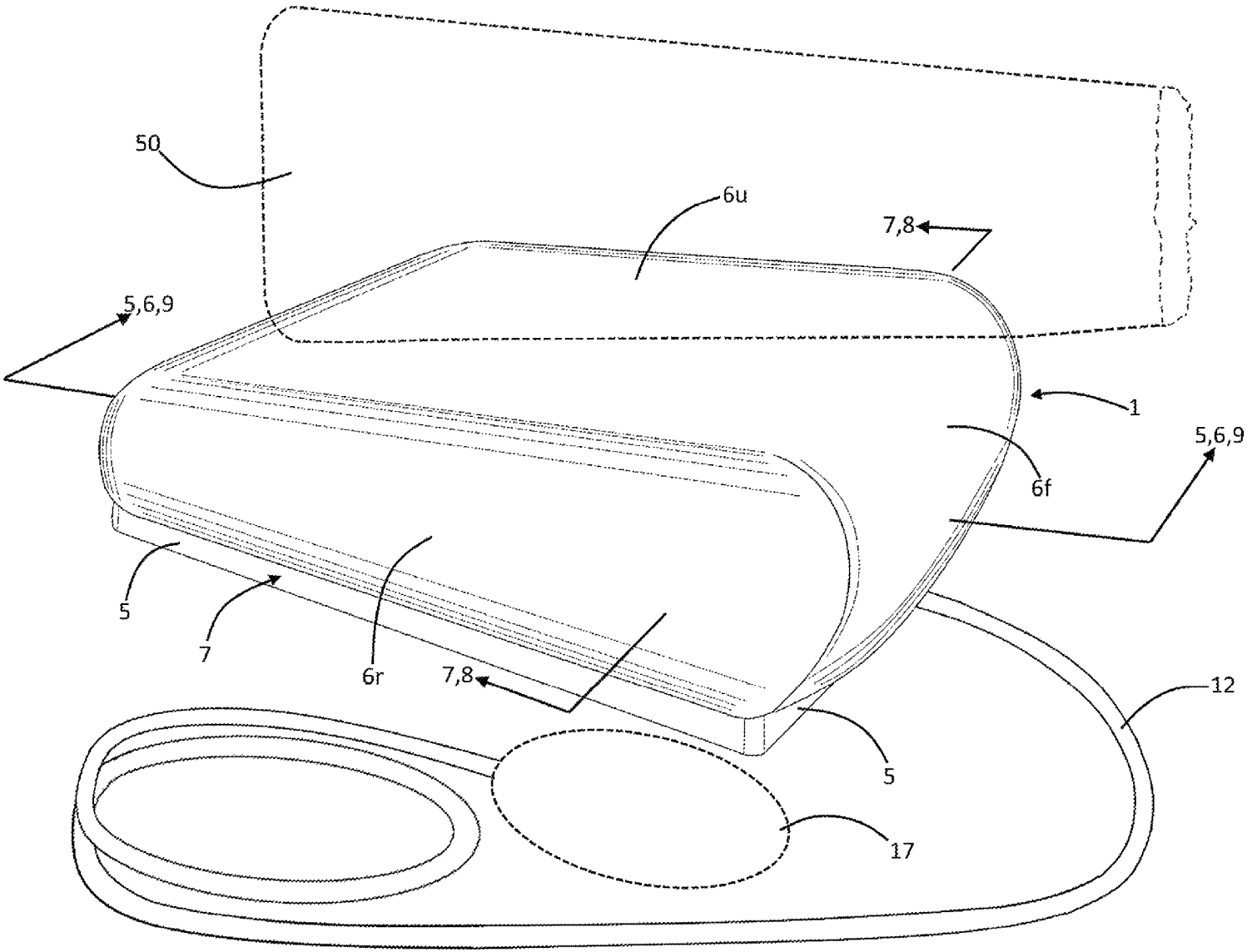
FIG. 1 is a perspective view of the instant inventive rifle buttstock support, the view showing in dashed lines a rifle's buttstock.
Figure 2:
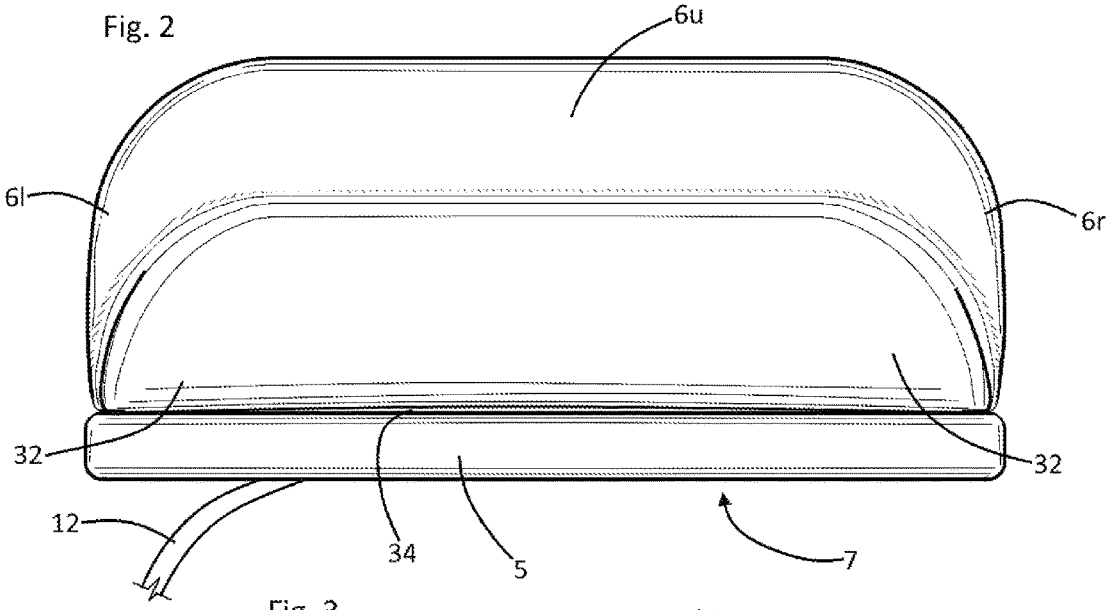
FIG. 2 is a rear view of the rifle buttstock support.

Referring now to the drawings, and in particular, simultaneously to FIGS. 1-3 and 5, a preferred embodiment of the instant inventive rifle buttstock support is referred to generally by reference arrow 1. The buttstock support 1 preferably comprises a base component which is referred to generally by reference arrow 7. Such base component 7 preferably comprises an interior plate or slab 4 housed within a closely fitting sheath 5. In a preferred embodiment, the sheath 5 is composed of vinyl or durable woven fabric. The interior plate 4 of the base 7 is preferably composed of a durable rubber slab, allowing the base to be temporarily bowed for facilitating insertion into the sheath 5. Such flexible bowing of the rubber plate effectively reduces the lateral cross-sectional area of the plate, allowing the plate to be slidably inserted into the sheath. Upon a release of the bowed plate within the sheath, the left and right ends of the plate extend laterally to flatten the plate and to cause the sheath 5 to stretch about and to closely cover the plate 4. The depicted base components 4, 5, 7, are intended as being representative other suitably utilized base plate components such as fiberglass plates, metal plates, wooden plates, plywood plates, and plastic plates.

A first flexible sheet 6 having right and left ends is preferably fixedly attached, suitably by stitching 9, longitudinally along the right and left sides or ends of the base 7. Such first flexible sheet 6 preferably comprises an upper section **6*u*, a rightward section or side 6*r*, a leftward section or side 61, and a forward section or side 6*f*. In the preferred embodiment, such first flexible sheet 6** is composed of durable vinyl fabric or woven fabric.

Figure 5:
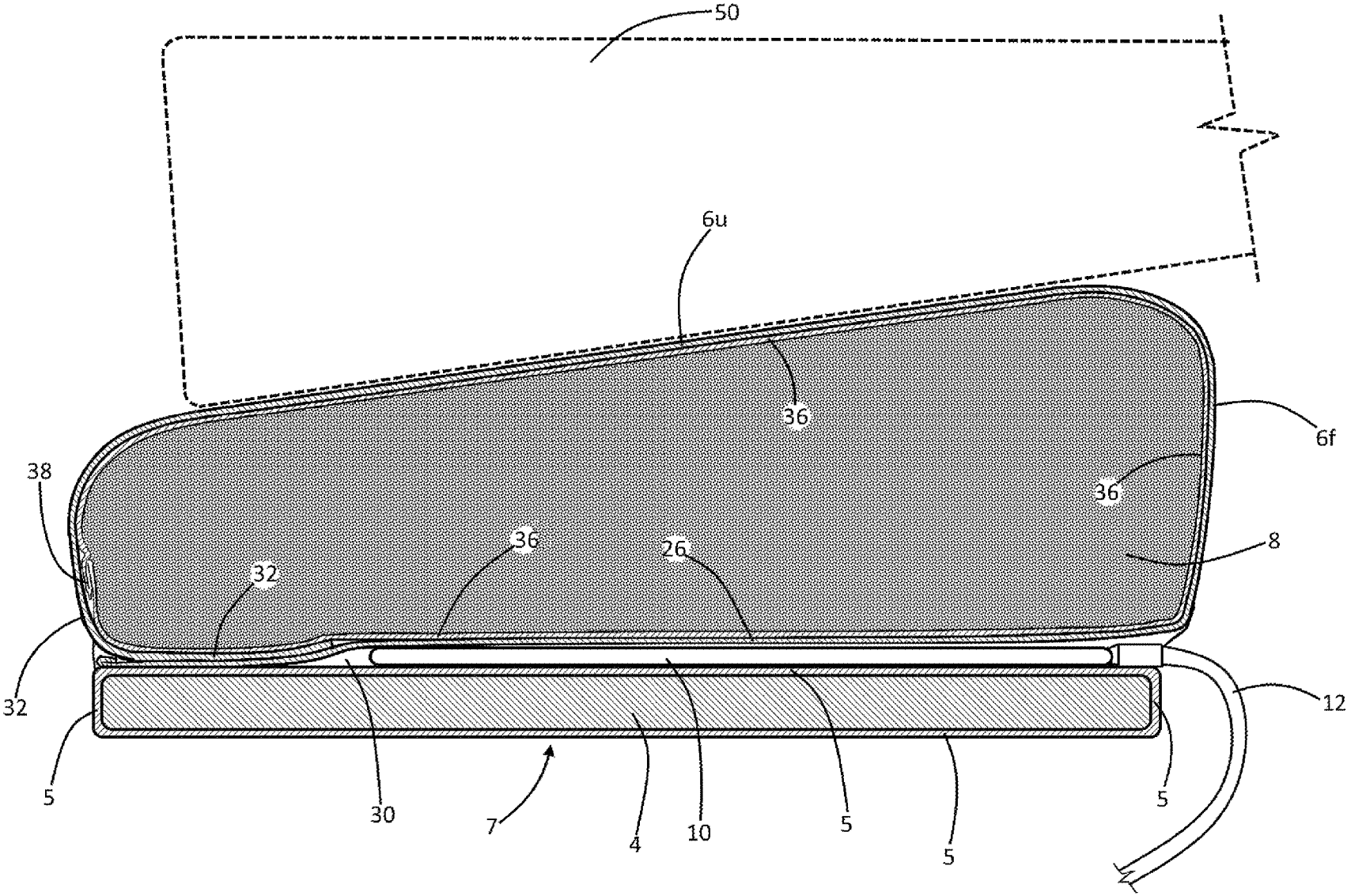
FIG. 5 is a sectional view as indicated in FIG. 1.

Referring in particular to FIG. 5, a body of particulate material 8 is housed and retained within the buttstock support, such material necessarily overlying the base 7 and underlying the upper section **6*u* of the first flexible sheet 6. In a preferred embodiment, the body of particulate material 8 comprises granular sand. Suitably, such material 8** may alternatively comprise another granular material such as rice, sawdust, or resin pellets.

A further structural component of the instant inventive rifle buttstock support comprises an expansible airbag 10. In a suitable embodiment, such airbag is of the type utilized in sphygmomanometer cuffs. The expansible airbag 10 necessarily overlies the base 7 and underlies the body of particulate materials 8.

Further components of the instant inventive rifle buttstock support comprise means for injecting air into the airbag 10, such means being represented in FIG. 1 by oval dashed line 17. Operation of the air injection means preferably drives compressed air via air tube 12 into the expansible airbag 10 for inflating such bag.

Figure 3:
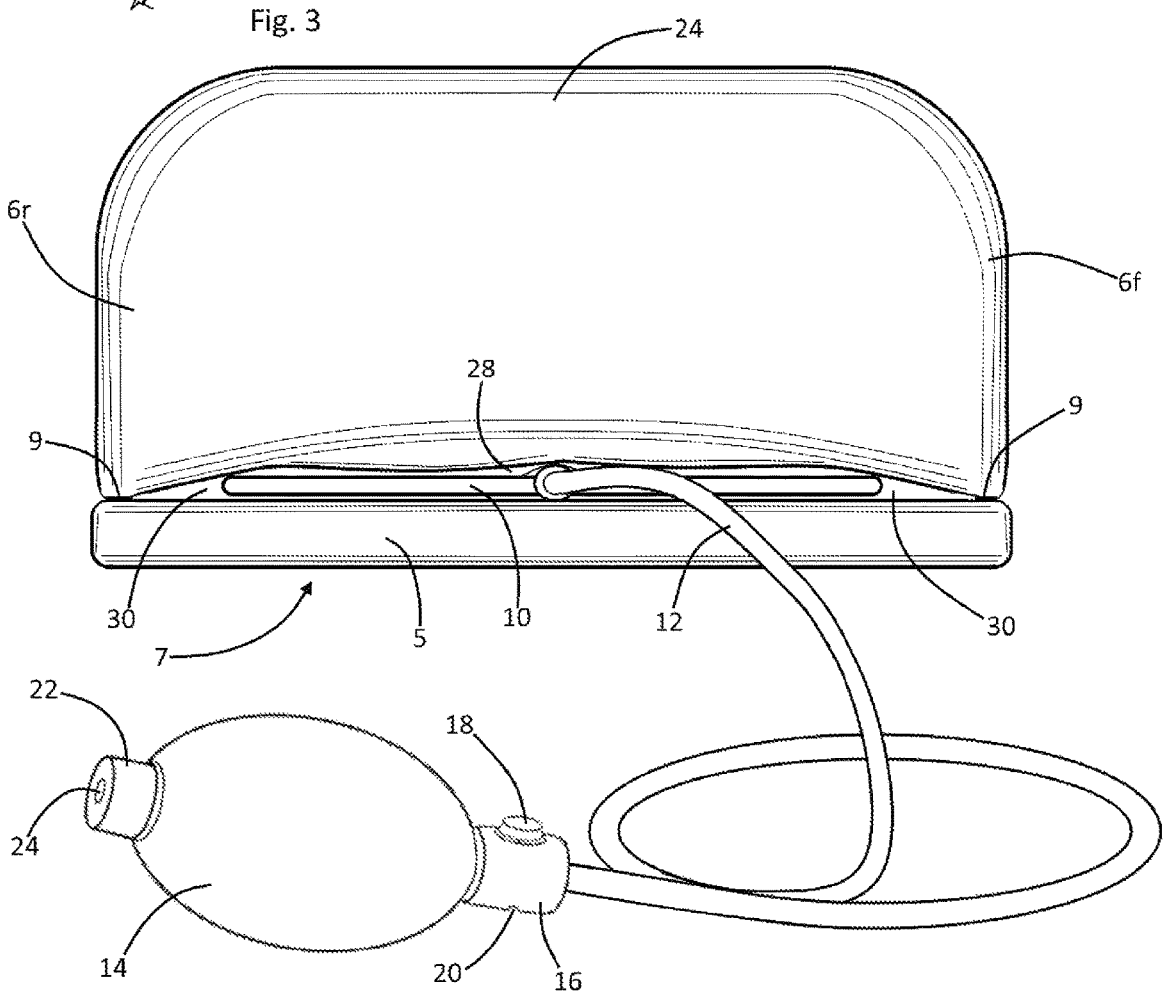
FIG. 3 is a front view of the buttstock support.

Referring in particular to FIG. 3 the air injecting means preferably comprises a bulb configured hand squeezable bellows 14 having an air input end 22, having an air input port 24, and having an air output end 16 which communicates with an air input end of the air tube 12. Such squeeze bulb air pump preferably internally incorporates a floating ball type check valve (not depicted within views) associated with its air input port 24, and includes a second check valve associated with its air output end 16. Repetitive squeezing of the bulb 14 drives air into the air tube 12, and flexible releases of the air bulb 14 draws air into air port 24. Portions of the injected air within the air tube 12 and air bag 10 may be selectively released by depression of a release valve opening button 18 at the output end 16 of the air bulb 24, such released air emitting at output port 20. The invention's air injecting means may suitably alternatively comprise a compressed air canister (not depicted within views) a piston type air pump (not depicted within views) or a motorized air compressor (not depicted within views).

In operation of the inventive buttstock support 1, a rifleperson may initially cause the rear stock or buttstock 50 of a rifle to rest upon the upper section **6*u* of the first flexible sheet 6. In such initial configuration, referring to FIG. 3, the expansible airbag 10 is preferably flat and deflated. In the event the rifleperson needs to lower the aimed trajectory of a fired bullet, the rifleperson may actuate the air injection means 17 causing the air bag 10 to inflate from the deflated configuration of FIG. 3 to, for example, the partially inflated configuration depicted in FIG. 4. As a result of such airbag inflation, the body of particulate materials 8 is driven upwardly, causing the upper section 6*u* of the first flexible sheet 6 to move upwardly. Such motion simultaneously raises the rifle's rear stock 50, lowering the rifle's aimed trajectory. Where the preferred squeeze bulb type air injection means is provided, as depicted in FIG. 3, slight applications of squeezing pressure applied to the bulb 14 may advantageously produce a fine or slight depressions of the aiming trajectory of the rifle. Alternatively, a short duration depression of air release button 18 may release of a small amount of air from air the air bag 10**, advantageously producing a fine or slight increase of the rifle aiming trajectory.

Figure 4:
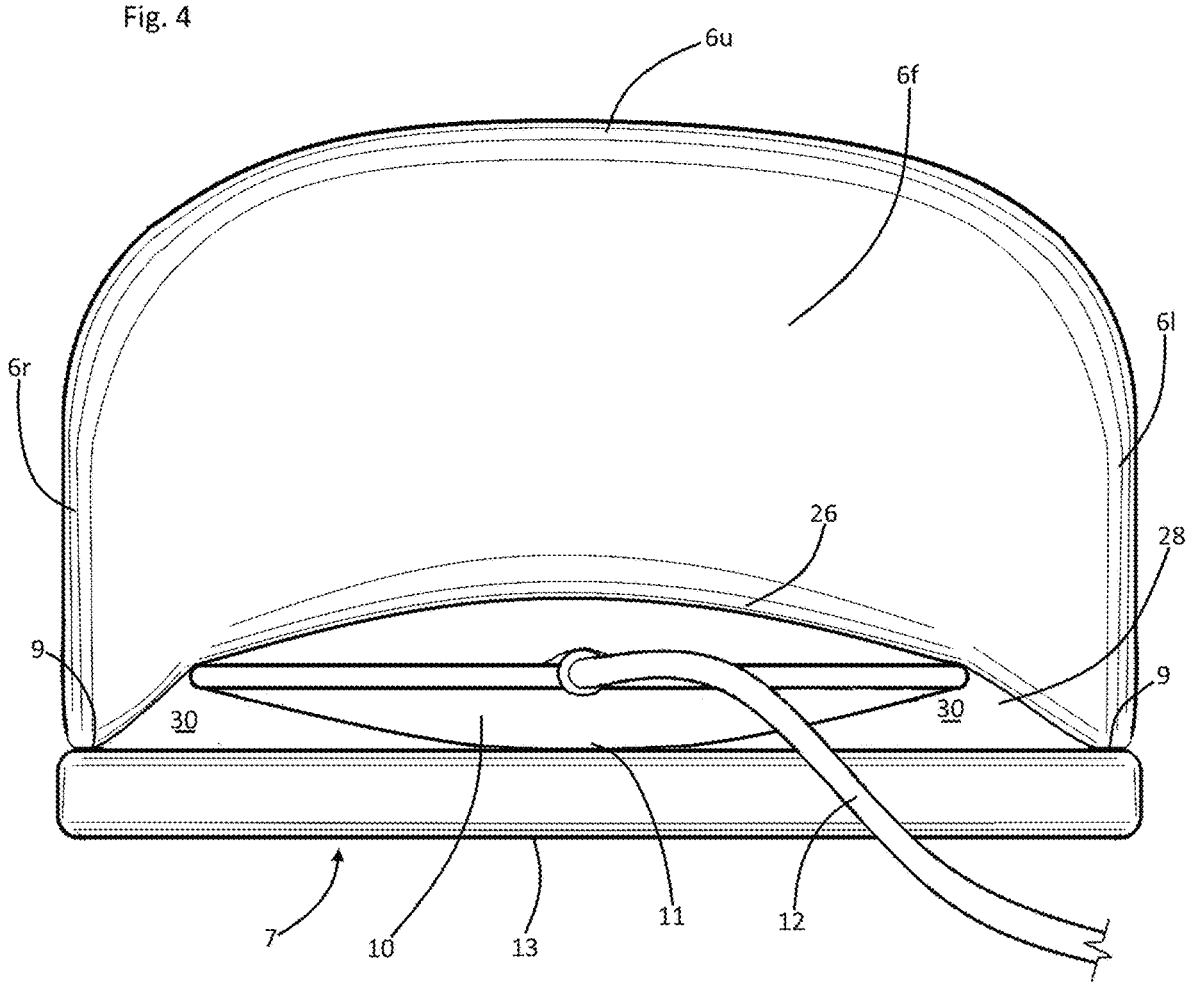
FIG. 4 re-depicts the structure of FIG. 3, the view of FIG. 4 alternatively an expansible airbag component in an inflated state.

Referring in particular to FIG. 4, it may be seen that, upon inflation of the airbag 10 the lower surface or lower stratum of the airbag 10 is downwardly convex. Such downward curvature of the air bag potentially undesirably produces a lateral instability of the buttstock support. To accommodate for and prevent such lateral instability, the right and left stitched attachments 9 of the flexible sheet 6 to the base 7 prevent arcuate curvature of the air bag from reflecting at the lower support surface 13 of the base 7. Accordingly, the buttstock support 1 advantageously maintains a flat and stable support of the rifle's rear stock 50 while the airbag 10 preforms pneumatically actuated raising and lowering functions.

Figure 7:
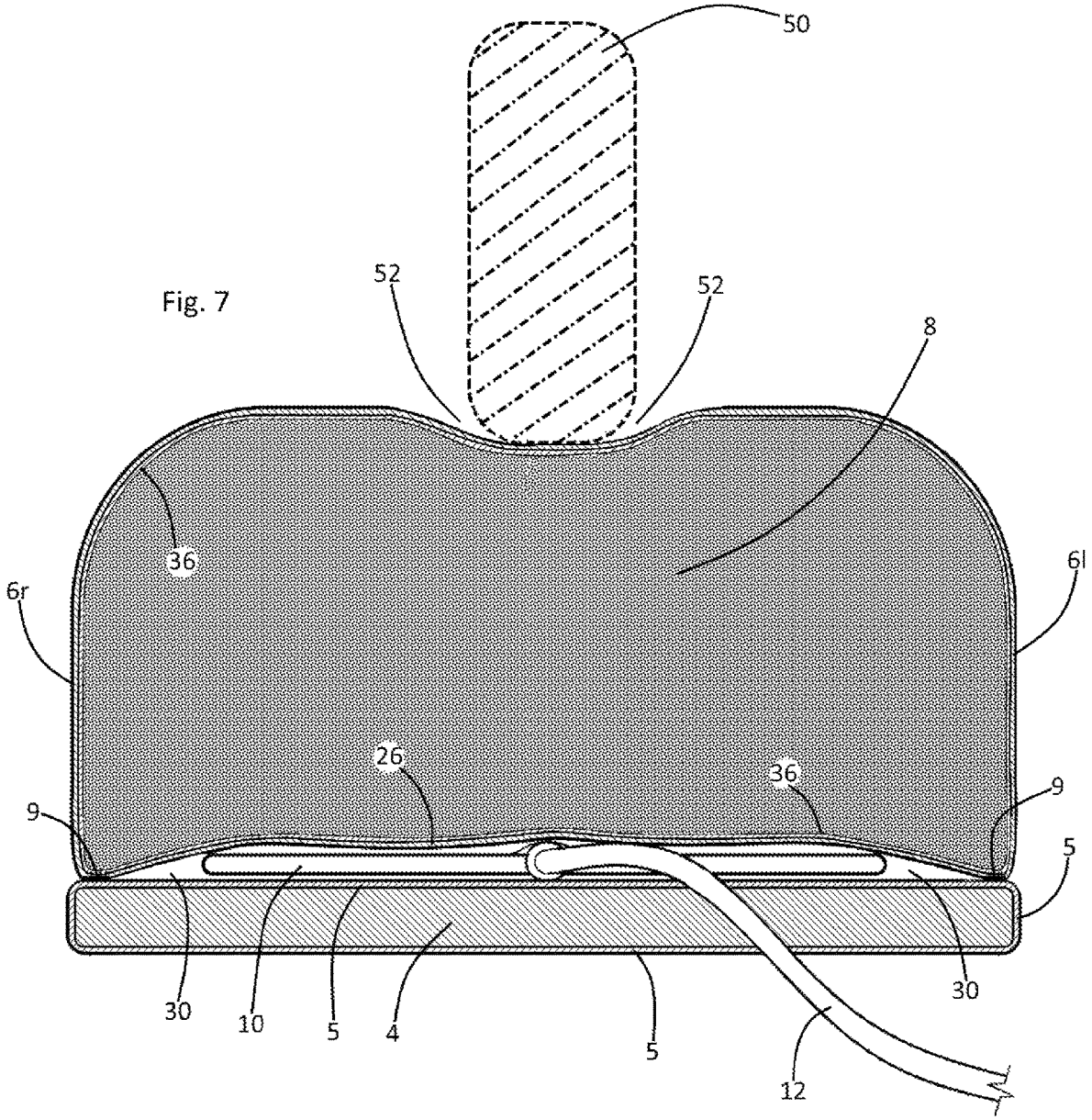
FIG. 7 is an alternative sectional view as indicated in FIG. 1.
Figure 9:
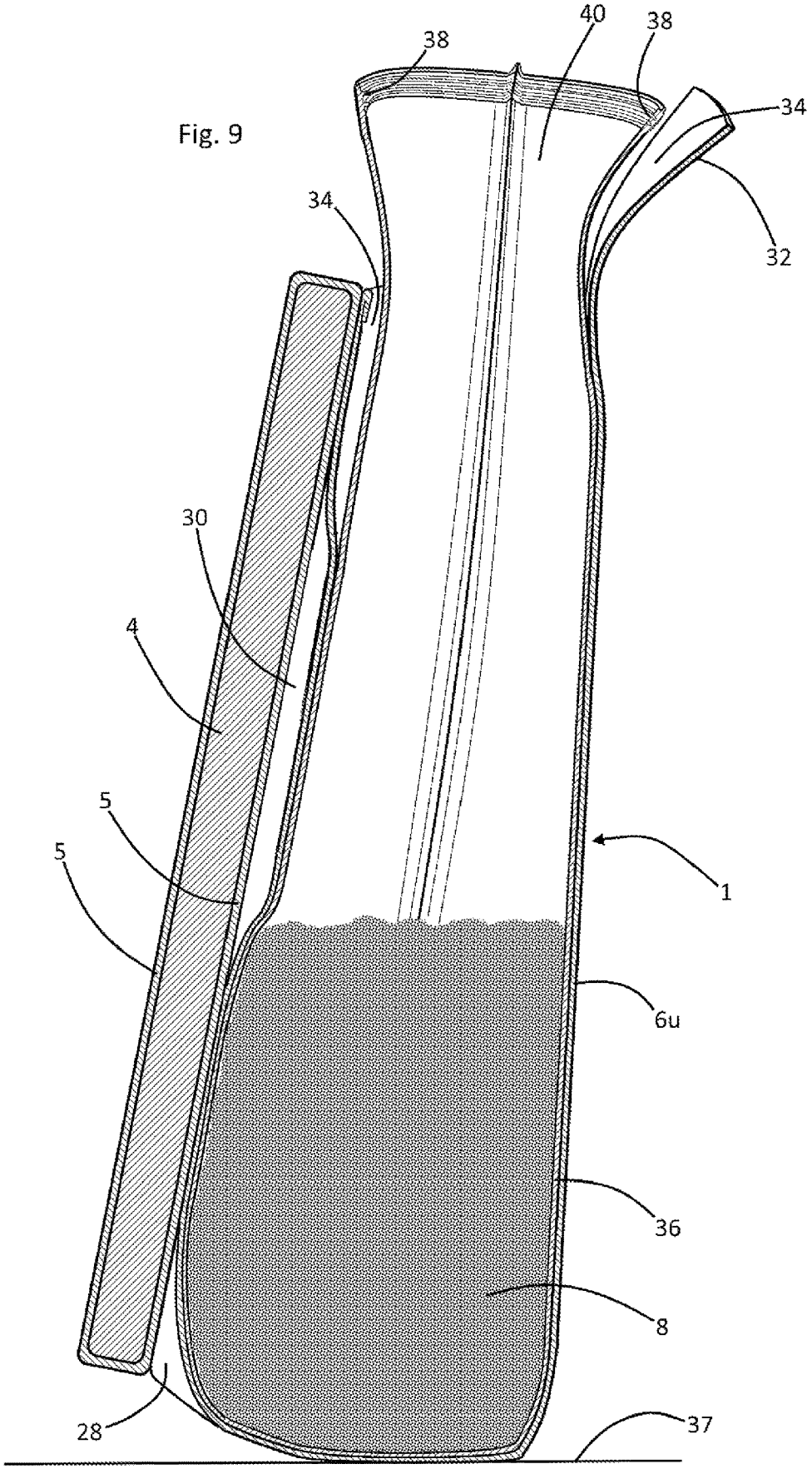
FIG. 9 re-depicts the structure of FIG. 5, with expansible bag removed, the view of FIG. 9 alternatively showing an upward orientation of the structure.

Referring simultaneously to FIGS. 5 and 7, the instant inventive rifle buttstock support preferably comprises a second flexible sheet 26 which spans laterally beneath the body of particulate material 8, such sheet extending between the right and left ends or sides **6*r* and 61 of the first sheet 6. Such second flexible sheet 26, in combination with the overlying central portion 6*u* of the first flexible sheet 6, advantageously forms and defines a first pocket which receives and houses the body of particulate materials 8. Referring further to FIG. 9, the first pocket component 6*u*, 26 is preferably opened by a rearward particulate materials passage port 34 which is closed by a closure flap 32. In the preferred embodiment, the closure flap 32 is formed wholly with the rearward end of the first flexible sheet's upper and central section 6*u***.

In addition to bounding and defining the first pocket, the second flexible sheet 26 functions in combination with the base 7 to form and define a second pocket 30, such second pocket housing and supporting the expansible air bag 10. The second pocket 30 necessarily underlies the first pocket 26, **6*u*, the second pocket preferably being forwardly opened by an airbag passage port 28**.

While the particulate material 8 may suitably be directly contained within the first pocket 26,6*u*, such material is preferably encased by and is hermetically retained within a plastic bag 36 which is nestingly received within such pocket. Referring in particular to FIG. 9, the rifleperson may initially remove the expansible airbag 10 from the second pocket 30 via forward extraction through the airbag passage port 28. Thereafter, the rifleperson may place the forward end of the buttstock support 1 upon a flat surface 37 as indicated in FIG. 9. Thereafter, the rifleperson may extend an initially empty plastic bag 36 downwardly into the first pocket space 6*u*,26, such bag extension passing downwardly through the particulate materials passage port 34. Thereafter, the rifleperson may pour the particulate material 8, preferably sand, downwardly through the bag's opening 40, filling the interior of the bag 36. Following filling, the bag's closure 38 may be engaged and closed. Thereafter, the closed end of the bag 36 may be tucked forwardly into the rearward end of the first pocket 6*u*,26. Thereafter, the closure flap 34 may be downwardly and forwardly folded to its pocket closing position as indicated in FIG. 5. Upon inversion of the buttstock support 1, the second pocket 30 is advantageously splayed or widened, allowing the deflated airbag 10 to be easily and conveniently reinserted to its use position as indicated in FIG. 5.

In the event the inventive rifle buttstock support 1 is utilized during a long distance rifle shooting competition which prohibits mechanically actuated adjustments of the firing orientation of the rifle, the rifleperson may easily and conveniently forwardly extract the expansible airbag 10 from the second pocket 30 by grasping and forwardly drawing the air bag 10 through the air bag passage port 28. Following such air bag removal, the partially disassembled buttstock support may be utilized in the manner of a conventional buttstock sand bag.

To facilitate adjustments of aiming trajectory during such conventional use of the buttstock support, the upper section 6*u* of the first flexible sheet 6 preferably slopes upwardly from its rearward end, as depicted in FIG. 5. The instant invention's provision of such sloped upper surface advantageously allows the buttstock support to function as a stock raising and lowering wedge. Slight forward movements of the rifle with respect to surface 6*u* may precisely lower the aiming trajectory of the rifle. Alternatively, slight rearward movements of the rifle may slightly and precisely upwardly adjust the aiming trajectory of the rifle.

Figure 6:
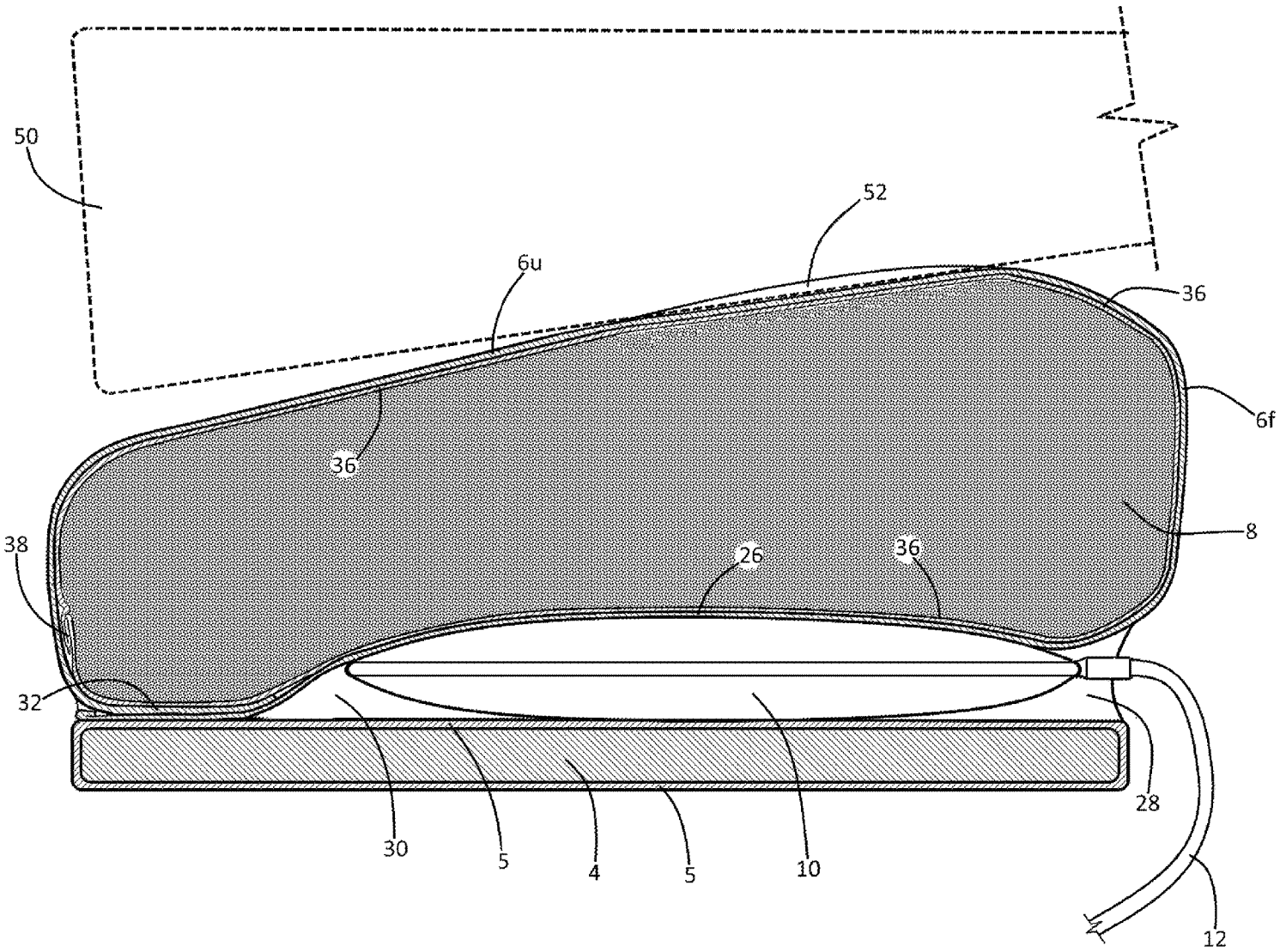
FIG. 6 re-depicts the structure of FIG. 5, the view of FIG. 6 alternatively showing the inflated expansible airbag component.
Figure 8:
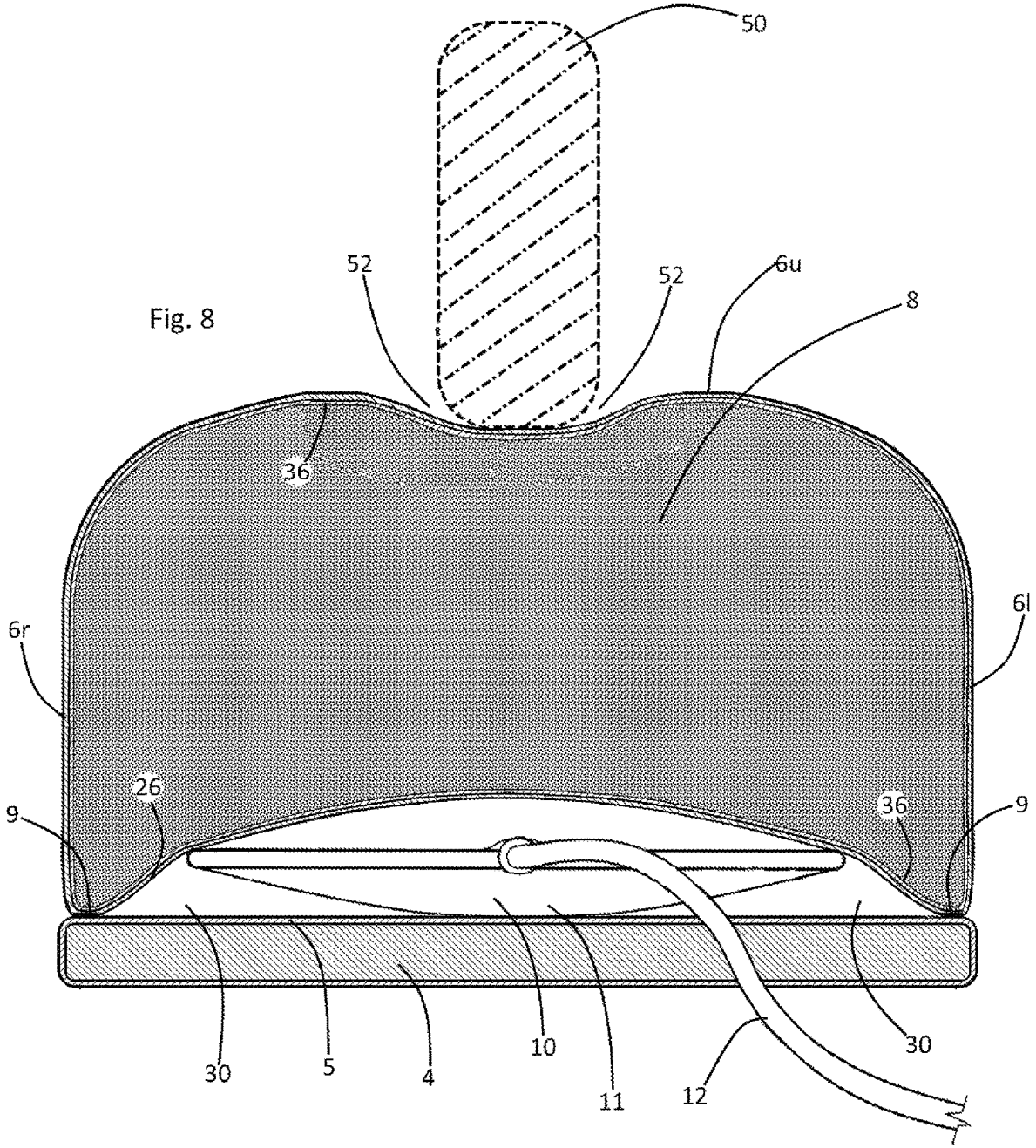
FIG. 8 re-depicts the structure of FIG. 7, the view of FIG. 8 alternatively showing the inflated expansible air bag component.

Referring to FIGS. 6, 7, and 8, it may be seen that the buttstock 50 may be downwardly pressed against the upper portion 6*u* of the first flexible sheet 6. Such downward pressure advantageously creates a buttstock cradling swale 52 which assists in resisting unwanted lateral or horizontal movements of the buttstock. It may be observed that the inflated airbag 10, in addition to its performance of the desired function of buttstock raising and lowering, may undesirably act as a pneumatic spring. If the lower surface of the buttstock 50 were to rest directly upon the upper surface of the inflated airbag 10, the pneumatic spring character of the bag would allow slight vertical oscillations of the buttstock during rifle aiming use, undesirably perturbing the rifle's aim. The body of particulate material 8 which overlies the airbag 10 and underlies the first sheet 6*u* and buttstock 50 advantageously buffers against and dampens such oscillations, helping the rifleperson to attain and hold the rifle's aim.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. A rifle buttstock support comprising:

a. A base having first and second ends;

b. A first flexible sheet having first and second ends respectively fixedly attached to the base's first and second ends:

c. A body of particulate material overlying the base and underlying the first flexible sheet;

d. An air bag overlying the base and underlying the body of particulate material;

e. Means for injecting air into the air bag; and f. a second flexible sheet overlying the airbag and underlying the body of particulate material.

2. The rifle buttstock support of claim 1 comprising a first pocket, said pocket being respectively upwardly and downwardly bounded by the first and second flexible sheets.

3. The rifle buttstock support of claim 2 comprising a second pocket, said pocket being respectively upwardly and downwardly bounded by the second flexible sheet and the base.

4. The rifle buttstock support of claim 3 wherein the first pocket is opened by particulate material passage port.

5. The rifle buttstock support of claim 4 wherein the second pocket is opened by an air bag passage port.

6. The rifle buttstock support of claim 5 comprising a flap fixedly attached to or formed wholly with the first flexible sheet, the flap being adapted for closing the particulate material passage port.

7. The rifle buttstock support of claim 6 comprising a flexible bag, said bag encasing the particulate material within the first pocket.

8. The rifle buttstock support of claim 3 wherein the base has a front end, a rear end, a right side, and a left side, wherein the base's first and second ends respectively comprise said right and left sides, wherein the first pocket's particulate material passage port opens rearwardly, and wherein the second pocket's air bag passage port opens forwardly.

9. The rifle buttstock support of claim 3 wherein the first flexible sheet has front and rear ends, and wherein said sheet slopes upwardly from its rear end.

10. The rifle buttstock support of Claim 1 wherein the air injecting means comprise a squeeze bulb and an air tube extending from the squeeze bulb to the air bag.

11. The rifle buttstock support of claim 10 wherein the squeeze bulb has an air inlet port, an air outlet port, and a pair of check valves operatively mounted at said ports.

12. The rifle buttstock support of claim 11 comprising a button actuated air release valve mounted at an input end of the air tube.

13. A rifle buttstock support comprising:

a. a base having first and second ends;

b. a first flexible sheet having first and second ends respectively fixedly attached to the base's first and second ends;

c. a body of particulate material overlying the base and underlying the first flexible sheet;

d. an air bag overlying the base and underlying the body of particulate material; and e. means for injecting air into the air bag; wherein the base comprises a plate and a sheath, the sheath being closely fitted to the plate.

14. The rifle buttstock support of claim 13, wherein the base's plate is composed of rubber.

15. A rifle buttstock support comprising:

a. a base comprising a plate, the base having first and second ends:

b. a first flexible sheet having first and second ends respectively fixedly attached to the base's first and second ends;

c. a body of particulate material overlying the base and underlying the first flexible sheet;

d. an air bag overlying the base and underlying the body of particulate material; and e. means for injecting air into the air bag; wherein the base is composed of a material selected from a group consisting of rubber, fiber glass, metal, wood, plywood, and plastic.

16. The rifle buttstock support of claim 15, wherein the base is received within the sheath.

* * * * *